US012668402B2

(12) United States Patent
Makos

(10) Patent No.: US 12,668,402 B2
(45) Date of Patent: Jun. 30, 2026

(54) UTILITY BOX AND CRANKBAIT STORAGE SYSTEM

(71) Applicant: Pure Fishing, Inc., Spirit Lake, IA (US)

(72) Inventor: Timothy S. Makos, Grafton, WI (US)

(73) Assignee: Pure Fishing, Inc., Spirit Lake, IA (US)

( * ) Notice: Subject to any disclaimer, the term of this patent is extended or adjusted under 35 U.S.C. 154(b) by 663 days.

(21) Appl. No.: 17/811,728

(22) Filed: Jul. 11, 2022

(65) Prior Publication Data

US 2023/0011990 A1 Jan. 12, 2023

Related U.S. Application Data

(60) Provisional application No. 63/220,270, filed on Jul. 9, 2021.

(51) Int. Cl.
*B65D 25/10* (2006.01)
*B65D 25/06* (2006.01)
*B65D 43/16* (2006.01)

(52) U.S. Cl.
CPC ..... *B65D 25/103* (2013.01); *B65D 25/06* (2013.01); *B65D 43/163* (2013.01)

(58) Field of Classification Search
CPC ..... A47L 19/00; A47L 19/02; A47L 19/04; B25H 3/003; B25H 3/04; B25H 3/06; B65D 25/103
See application file for complete search history.

(56) References Cited

U.S. PATENT DOCUMENTS 4,176,491 A * 12/1979 Herring ..... A01K 97/06 43/57.1
4,798,292 A * 1/1989 Hauze ..... A61L 2/26 206/439
5,098,676 A * 3/1992 Brooks, Jr. ..... A61L 2/26 422/550
6,038,784 A * 3/2000 Dunn ..... F26B 25/18 211/41.6
10,694,731 B2 * 6/2020 Aston ..... A01K 97/06
2014/0262922 A1 * 9/2014 Johnson ..... B25H 3/06 206/565
2023/0155415 A1 * 5/2023 Yoon ..... H02J 50/12 320/107

* cited by examiner

*Primary Examiner* — Javier A Pagan
(74) *Attorney, Agent, or Firm* — Husch Blackwell LLP

(57) ABSTRACT

A utility box or storage system that includes one or more configurable storage compartments. The utility box or storage system can comprise a compartment having a first wall that includes a guide and a second wall, and a plurality of storage units, including at least one of the plurality of storage units that implants into the compartment between the first wall and the second wall. The at least one storage unit can include a ridge that aligns with the guide. The guide can engage the ridge to guide the storage unit during implantation.

10 Claims, 19 Drawing Sheets

UTILITY BOX AND CRANKBAIT STORAGE SYSTEM

CROSS-REFERENCE TO RELATED APPLICATIONS

This application claims priority to U.S. Provisional Patent Application Ser. No. 63/220,270, filed on Jul. 9, 2021, the entirety of which is incorporated herein by reference.

FIELD OF THE DISCLOSURE

The disclosure relates generally to a utility box and storage system for storing articles such as fishing tackle, bait, equipment or tools.

BACKGROUND OF THE DISCLOSURE

Fishing tackle boxes are useful for carrying fishing gear, including lures, hooks, tools, and other small items generally related to the sport of fishing. A wide variety of fishing tackle boxes are known in the art.

In order to be prepared for various fishing conditions and to attract and catch different varieties of fish, many fishermen carry a variety of different lures and hooks in their tackle boxes. Accordingly, most existing tackle boxes include a variety of distinct storage compartments that can be used to separate and organize these items.

After using a lure or hook for fishing, the lure or hook may be wet. This presents a problem as storing a wet item in a tackle box could lead to rust, mildew, or other associated issues. The present disclosure seeks to address this and other problems.

SUMMARY OF THE DISCLOSURE

A storage solution, including a utility box or storage device, is disclosed that provides substantial advantages over existing storage solutions. The storage solution can include a utility box having a storage system with reconfigurable compartments. The utility box can comprise a compartment having a first wall that includes a guide and a second wall, and a plurality of storage units, including at least one of the plurality of storage units that implants into the compartment between the first wall and the second wall. The at least one storage unit can comprise a ridge that aligns with the guide. The guide can engage the ridge to guide the storage unit during implantation. The guide can secure the storage unit in a seated position in the compartment between the first wall and the second wall.

The second wall can include a second guide that is positioned opposite to and aligned with the first guide. The second wall can include a fulcrum member that can support a rod and cover to form the retainer compartment when configured in the closed position.

The storage unit can comprise a ramped inner wall, an opening that is configured to hold a bullet-shaped article, drain holes to allow fluid to drain from a space in the storage unit, an internal guide, a divider having a portion that is adapted to be implanted in an internal guide, or a cover.

The storage unit can comprise a tray having a channel. The tray can have a pair of opposing main surfaces and said channel is formed in a first one of the pair of opposing main surfaces. The second of the pair of opposing main surfaces can comprise one or more channels.

The storage system can comprise a plurality of fingers and a base. The plurality of fingers can be configured to receive and hold an article to prevent damage. The base can include a magnetic material. The article can be crankbait. At least one of the plurality of fingers can comprise a soft rubber material.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced.

Figure 1:
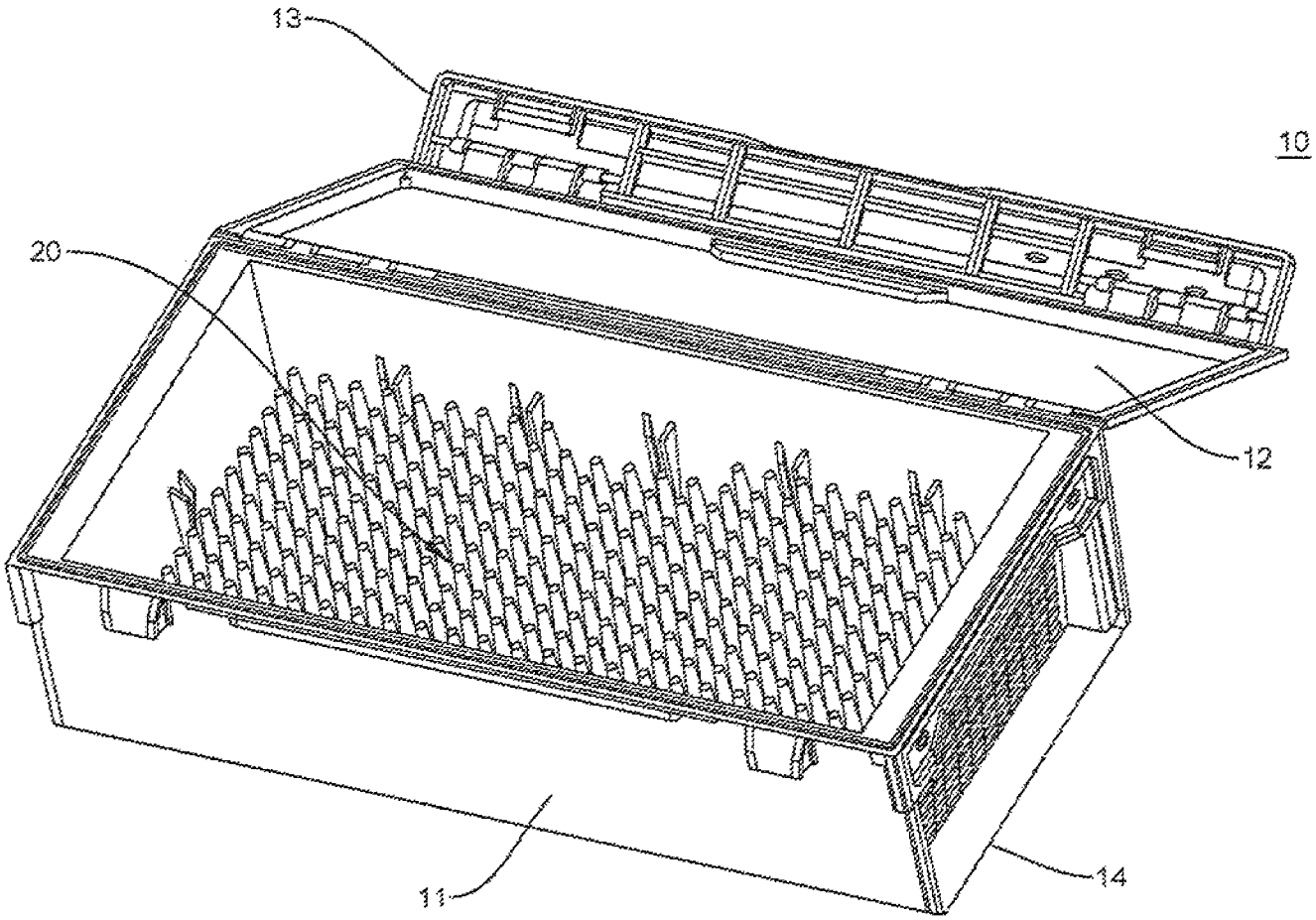
FIG. 1 shows an embodiment of a utility box, constructed according to the principles of the disclosure.

The present disclosure is further described in the detailed description and the drawings that follows.

DETAILED DESCRIPTION OF THE DISCLOSURE

The embodiments of the disclosure and the various features and advantageous details thereof are explained more fully with reference to the non-limiting embodiments and examples that are described or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

A utility box can be made in any shape, size, finish, color or material. The utility box can store articles such as, for example, bait, crankbait, tackle, weights, floats, tools, or any other item that might be useful to the user. The utility box can include a storage system that protects attributes of the articles such as finish or color against damage. The storage system can efficiently store a larger number of articles than existing storage solutions using the same footprint. The storage system can control movement, access to, or organization of articles in the utility box. It can allow quick and easy to find access of articles in a utility box, while avoiding typical wear and tear on articles that might be caused by them shifting inside the utility box. The storage system can provide modularity and reconfigurability that enable customization.

FIG. 1 shows a non-limiting embodiment of a utility box 10 that can include a non-limiting embodiment of a storage device 20, according to the principles of the disclosure. The utility box 10 can include a front portion 11, a back portion (not shown), a top portion 12, a bottom portion 14, and a pair of side portions. The utility box can include a latch device 13, which can be affixed to or formed integrally with the top portion 12. The latch device 13 can be arranged to attach to the front portion 11 to secure the utility box 10 in a closed position. The utility box 10 can be configured so the top portion 12 can close and seal any articles in the utility box 10 when in the closed position (shown in FIG. 1), thereby holding the articles in the utility box 10. The storage system 20 can prevent shifting or migration of articles in the utility box 10, such as, for example, during transport. The utility box 10 can be made in any shape, size, finish, color or material. The top portion 12 can include a transparent material, so that articles in the utility box 10 can be viewed without having to open the utility box 10.

As seen in FIG. 1, the storage device 20 can be configured to fit substantially the entire inner bottom (or floor) area in the utility box 10. The storage device 20 can be configured to fit a portion of the entire inner bottom area. The storage device 20 can be sized or shaped to fit any desired area in the storage system 20. The storage device 20 can be attached to an inner wall of the utility box 10.

Figure 2:
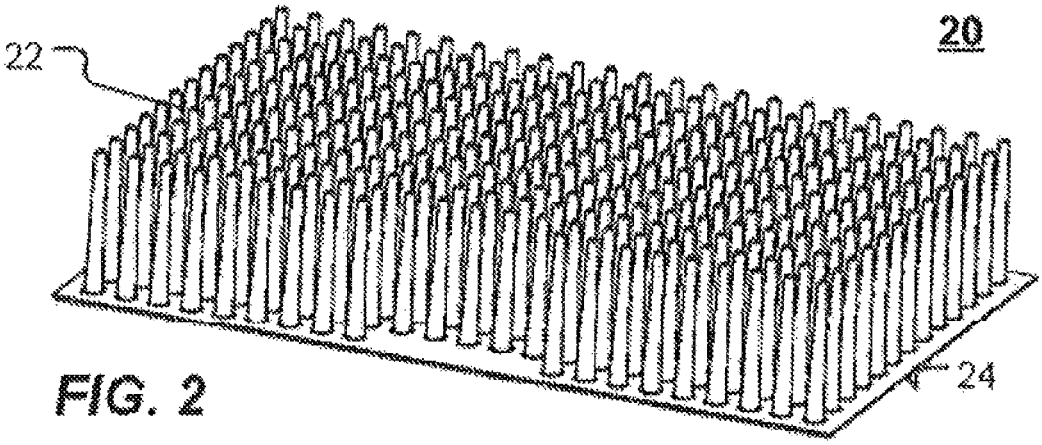
FIG. 2 shows an embodiment of a storage device, constructed according to the principles of the disclosure.

FIG. 2 shows a perspective view of the storage device 20. The storage device 20 can include a plurality of fingers 22 and a base 24. The fingers 22 and base 24 can be made of the same material or they can include different materials. The material(s) can include, for example, a rubber material (including open or closed cell rubber) such as silicone, neoprene, or fluorosilicone, or a plastic material (such as polyethylene terephthalate PETE or PET), polyvinyl chloride (PVC), low-density polyethylene (LDPE), polystyrene or Styrofoam (PS), or any material that can provide a stiffness necessary to retain and secure articles (for example, crankbait or spinner bait) that can be stored in the storage device 20. The base 24 can include a magnetic or adhesive material, typically on an underside thereof. The base 24 can include a hook-and-loop fastener such as, for example Velcro. The base 24 can include drainage holes (not shown) to allow liquid to drain through the base 24, such as, for example, water that drips down from bait or tackle after usage. The drainage holes (not shown) can allow the liquid to seep through the base 24 to the bottom of the utility box 10, which can include drainage holes (not shown) to allow the liquid to flow out of the bottom of the utility box 10.

The fingers 22 and base 24 can be made as one piece or the fingers 22 can be attached to the base 24. The dimensions of each finger 22 can be selected based on the application for the storage device 20. For instance, FIGS. 13, 14, and 18 (described below) illustrate embodiments in which fingers 22 have different dimensions based on the application of the storage device 20. Each of the fingers 22 can, for example, be made to have a length that is as long as a length of a portion of the article 18, such as, for example, the hook portion of the crankbait shown in FIG. 5. The storage device 20 can be made in any shape, size, or color. The storage device 20 can be constructed to be easily removed or implanted in or on a structure. The storage device 20 can be modular or customizable. The storage device 20 can be implanted in the utility box 10 or used separately by itself, such as, for example, by placement or attachment to a surface such as, for example, a shelf, tool box, a truck bed, tackle bag, or any other surface that can support the base 24.

The storage device 20 can be constructed to be flexible and foldable, so that a user can fold the storage device 20, for example, in half with the fingers 22 on each half facing each other to sandwich one or more articles in the space formed between the two halves. The folded storage device 20 can be implanted in a compartment 19 (shown in FIG. 6) of the utility box 10.

Figure 3:
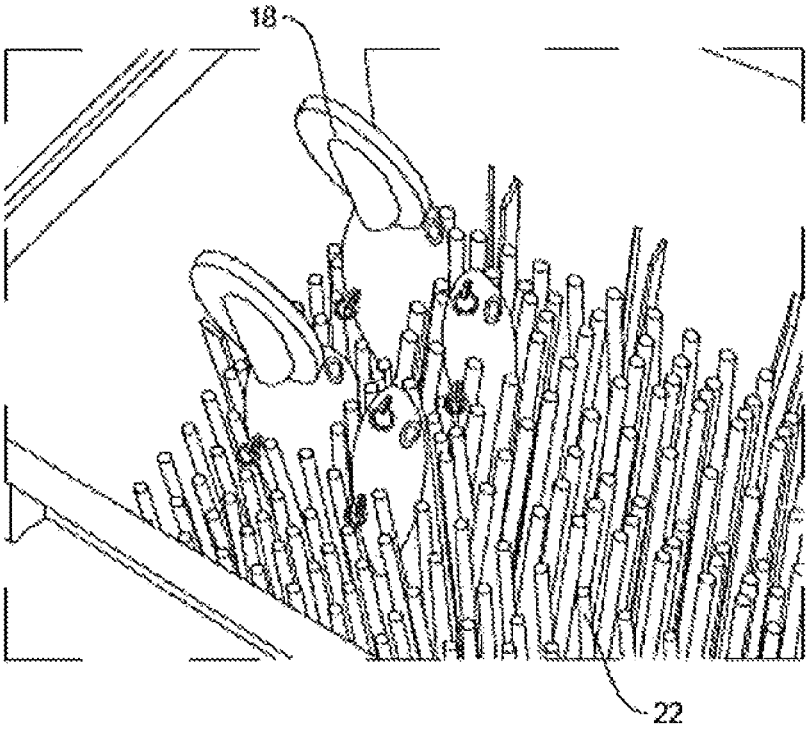
FIG. 3 shows an enlarged view of a portion of the storage device shown in FIG. 2.
Figure 5:
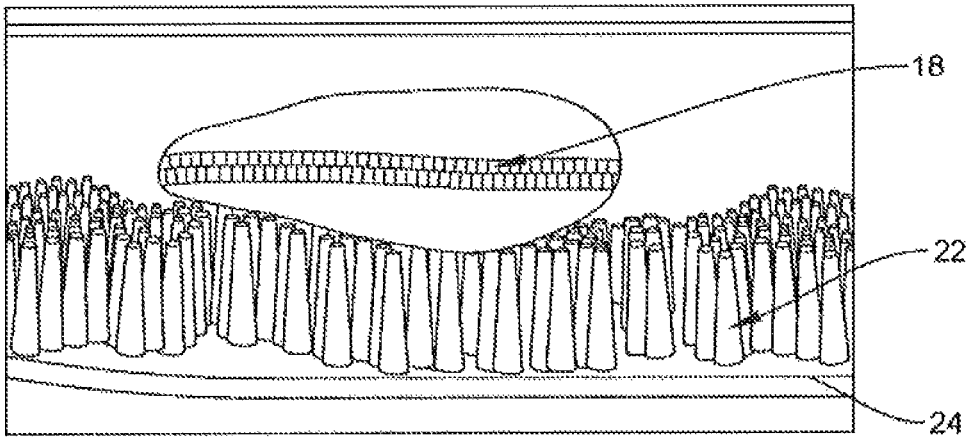
FIG. 5 shows an enlarged view of a portion of the utility box in FIG. 4, including a partial view of the storage device.

FIG. 3 shows an enlarged view of a portion of the storage device 20. Articles 18 such as crankbait can be implanted into the storage device 20 or placed atop of the storage device 20, as seen in FIG. 5. The articles can be implanted, for example, by inserting the articles 18 into the fingers 22, as seen in FIG. 3. One or more rows or columns (or lines) of fingers 22 can be positioned between any adjacent articles so as to prevent the articles from contacting or damaging each other.

Figure 4:
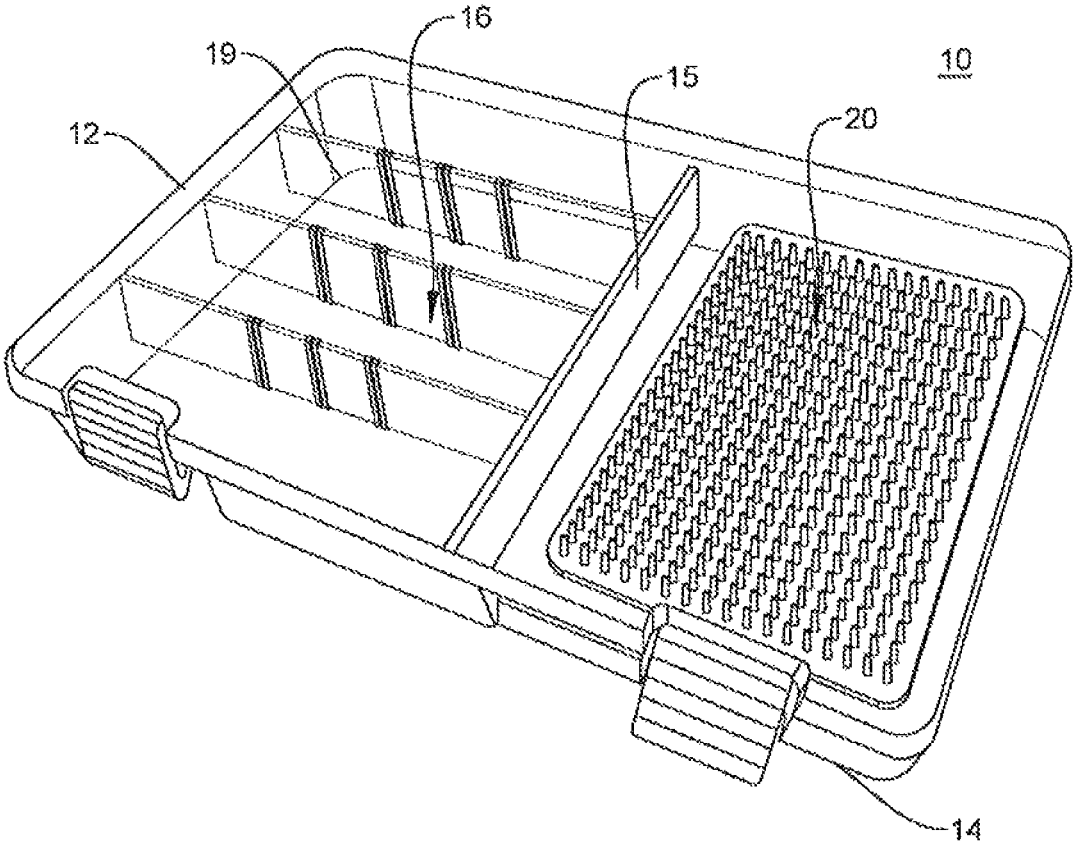
FIG. 4 shows the utility box with an embodiment of a storage system, according to the principles of the disclosure.

FIG. 4 shows the utility box 10 with an embodiment of a storage system 16. The storage system 16 can include the storage device 20, including the plurality of fingers 22 and base 24. The storage system 16 can include one or more dividers 15 that form compartments 19. The dividers 15 can be removable, affixed to or made integrally with the utility box 10 bottom portion 14 as one piece. The storage system 16 can be made to be implantable or removable, or the storage system 16 can be made as one part with the bottom portion 14 of the utility box 10. The storage system 16 can include one or more storage units 40 (for example, shown in FIGS. 7-9E). The storage units 40 can be designed to be removable or implantable, so as to allow the user to customize the storage system 16 to a particular application or need of the user.

FIG. 5 shows an enlarged view of a portion of the utility box 10 (shown in FIG. 4), including a partial view of the storage device 20 with the article 18, which can include, for example, a crankbait.

Figure 6:
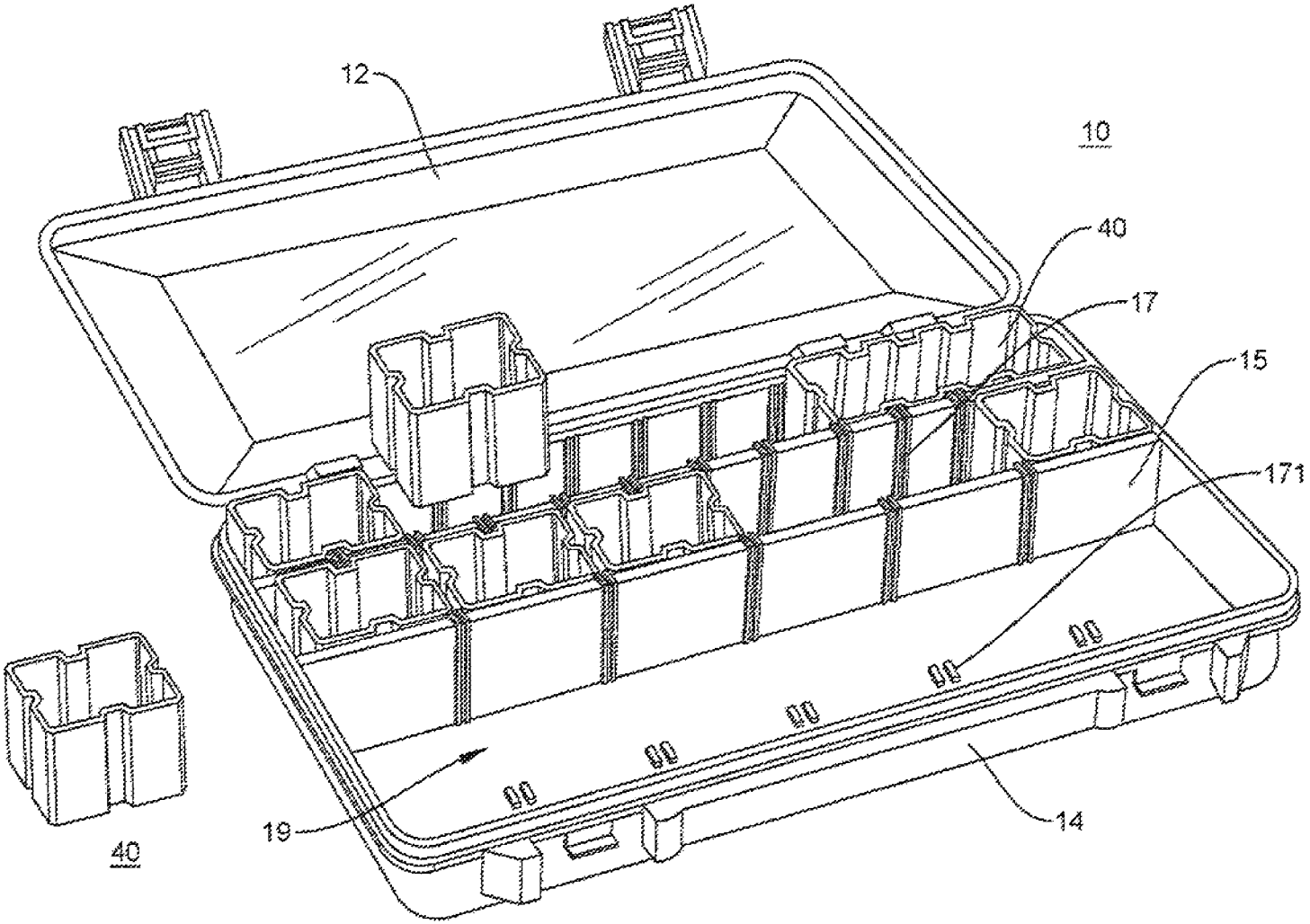
FIG. 6 shows an embodiment of a utility box with removable storage units.

FIG. 6 shows the utility box 10 with another embodiment of the storage system 16, which has a different configuration of compartments 19 than the embodiment shown in FIG. 4. Each compartment 19 can be formed by at least one of a pair of adjacent dividers 15, a divider 15 and an inner wall of the bottom portion 14, or the inner walls of the bottom portion 14.

As seen in FIG. 6, the top portion 12 can be opened to allow access to the compartments 19 in the storage system 16 and, more particularly, one or more storage units 40 implanted in the compartments 19. Each storage unit 40 can include a structure designed to hold articles such as, for example, ammunition, drill bits, drivers, ammunition cans, or any other article that a user might find desirable or useful for a particular application, such as a recreational application like fishing, hunting, crafting, or camping, or an industrial or personal application. The storage unit 40 can be configured to be stackable with another storage unit 40. The storage unit 40 can include a cover, which can be removably or permanently affixed to or formed integrally with the storage unit 40. The storage unit 40 can include drainage holes.

The storage system 16 can include one or more dividers 15 or an inner wall of the bottom portion 14 having one or more guides 17. The utility box 10 can include one or more guides 171, which can be aligned with the guides 17. The guides 171 can be located on the floor of the bottom portion 14 and aligned with corresponding guides 17 on the divider 15 and/or an inner wall of the bottom portion 14. Two or more guides 17 can be located opposite each other in the compartment 19 and constructed to guide the storage unit 40 (or a removable divider 15) as it is implanted into (or removed from) the compartment 19. The guide 171 can be arranged to receive and hold the storage unit 40 when it is fully implanted in the compartment 19, such as, for example, when the storage unit 40 is pushed all the way into the compartment 19 and contacts the floor of the bottom portion 14. The guide 171 can include an engagement member (for example, a clip, clamp, or tongue-and-groove fastener) that can engage and secure a bottom portion (not shown) of the storage unit 40 (or removable divider 15) in the compartment 19.

The compartment 19, including guides 17 or 171, can be configured such that a force of about, for example, 5 lbs/in$^2$ or more would be necessary to extract the storage unit 40 (or divider 15) from the compartment. The guides 17 and/or 171 can be integrally formed as one piece with the divider 15 and/or bottom portion 14, or constructed to be removal or attachable to the bottom portion 14.

Figure 7:
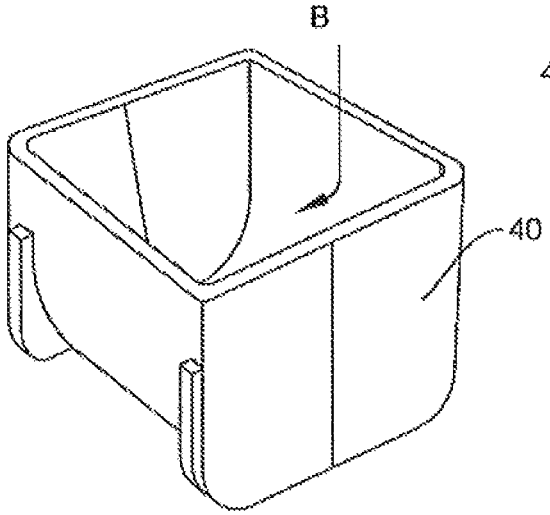
FIGS. 7 and 8A show embodiments of a storage unit.

FIG. 7 shows a non-limiting embodiment of the storage unit 40 that can be included in the storage system 16. The storage unit 40 can be constructed with a rounded bottom and/or one or more inner walls that are ramped or graded to facilitate a scooping action B by a user hand to allow the user to easily grasp small articles, such as, for example, beads, 22-caliber ammunition, pellets, BBs, powder, crystals, or a fluid.

Figure 8B:
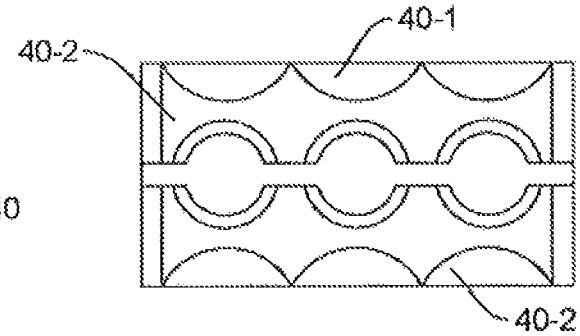
FIGS. 8B and 8C show embodiments of trays that can be used with the storage unit in FIG. 8A.
Figure 8C:
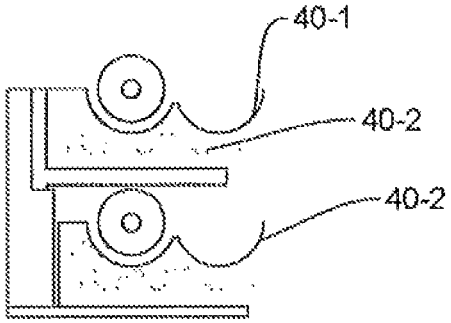
Figure 8A:
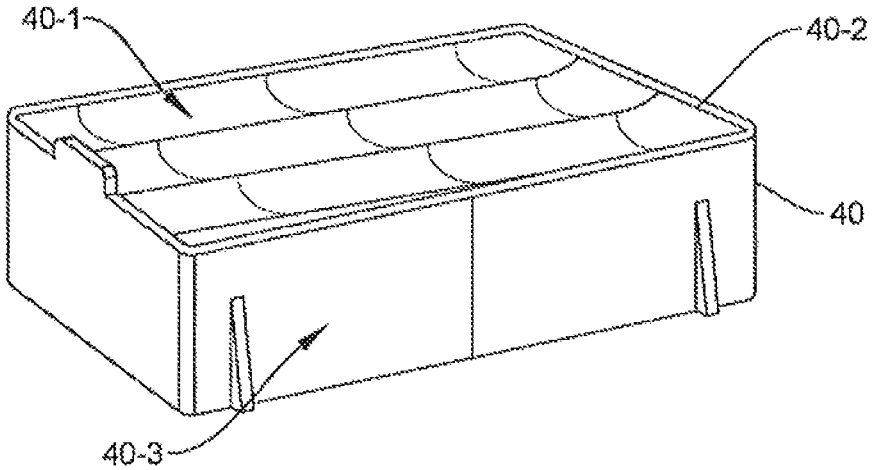

FIG. 8A shows another non-limiting embodiment of the storage unit 40, which is designed to hold spherical, cylindrical or bullet-shaped articles such as, for example, titanium fishing weights. In this example, the storage unit 40 is designed to prevent any damage to the finish of the articles during events such as transport. The storage unit 40 can include a plurality of recesses 40-1, each one arranged to hold an article and prevent the article from contacting an article located in an adjacent recess 40-1. All the recesses 40-1 can have the same shape or size, or the recesses 40-1 can each have a different shape or size. The recess 40-1 can be constructed to have a depth that leaves a portion of the article exposed for easy grasping by the user. The recesses 40-1 can be formed as a plurality of parallel channels. The recesses 40-1 can be formed in a tray 40-2.

The tray 40-2 can be made as one piece with the storage unit 40. The tray 40-2 can be made as a separate piece and arranged to attach to the storage unit. The tray 40-2 can be made of, or the channels can be lined with, a non-abrasive material such as rubber silicone. The non-abrasive material can include a high friction material, such as the rubber silicone, which can securely hold the article in place, without damaging the finish or color on the article. The channels can be configured to hold articles such as, for example, bullet-shaped fishing weights.

FIGS. 8B and 8C show two non-limiting embodiments of trays 40-2 that can be installed in the storage unit 40 shown in FIG. 8A. As seen in FIG. 8B, the tray 40-2 can include recesses 40-1 on both the top and bottom planar surface. Alternatively, as seen in FIG. 8C, the recesses 40-1 can be formed in only the top or bottom planar surface. The trays 40-2 can be constructed to stack one atop another, as seen in FIG. 8B or 8C. As seen in FIG. 8B, the trays 40-2 can be designed to stack atop of one another so that the recesses 40-1 align with each other to form cylindrical channels or compartments. The recesses 40-1 can be designed to form any shape, depending on the shape of the article that might be stored in the recess 40-1.

Figure 9A:
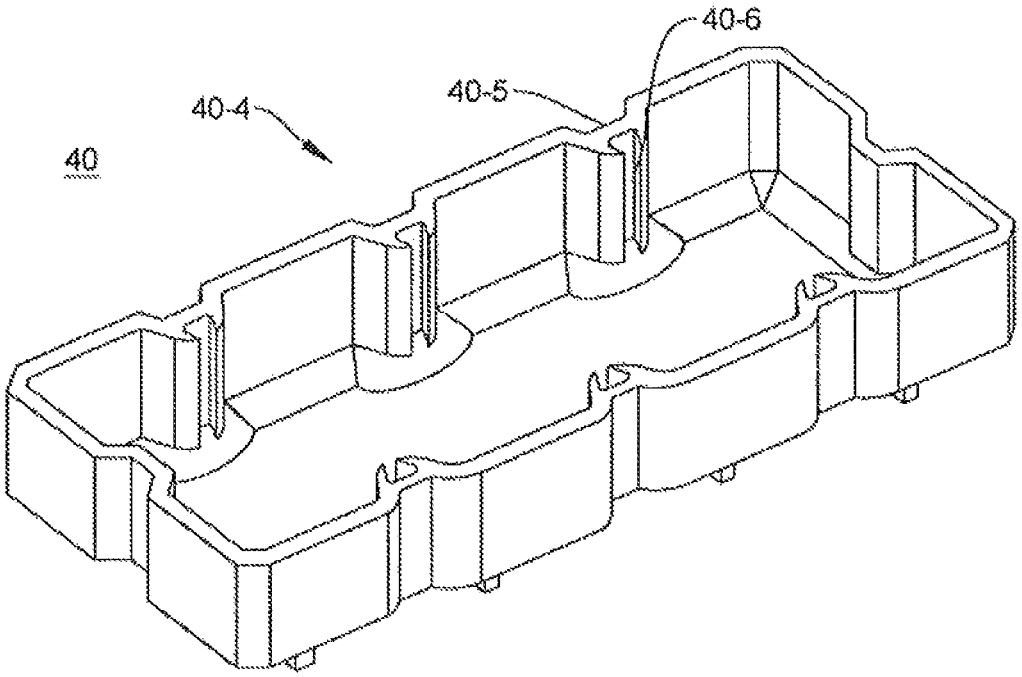
FIGS. 9A to 9E show further embodiments of the storage unit.

FIGS. 9A-9E show non-limiting embodiments of the storage unit 40. FIG. 9A shows the storage unit 40 having a storage body 40-4 that is shaped to fit the contours of the compartment 19 in the utility box 10 (shown in FIG. 6). In this non-limiting embodiment, the storage body 40-4 can be constructed with varying width, height, depth or length dimensions. The dimensions or shape of the storage body 40-4 can vary depending on the shape of the compartment 19 in which the storage unit 40 is to be implanted, the number storage units 40 that are to be implanted in the utility box 10, or the particular application for which the storage unit 40 will be used.

For instance, the storage body 40-4 can be constructed to have the shape shown in FIG. 9A and a height or depth such that two or more storage units 40 can be stacked atop of each other and implanted in the same compartment 19 to provide multi-level storage. The multi-level storage can be useful in applications where, for example, each storage unit 40 holds a different article, but, due to the size or quantity of the articles, a substantial portion of the space provided by the compartment 19 would go unused. Hence, by allowing a user to stack two or more storage units 40 atop of each other in the same compartment 19, usage of the compartment space can be maximized, while simultaneously separating different types of articles and limiting movement of the articles within each storage unit 40, such as, for example during transport. The two or more storage units 40 can include an attachment mechanism (not shown) such as, for example, tongue-and-groove, so that the bottom of one storage unit 40 can fixedly attach to the top of the other storage unit 40 and both storage units 40 implanted or removed from the compartment 19 as a single unit.

The storage body 40-4 can include one or more external guides 40-5, each of which of can include a channel formed in an external wall of the storage body 40-4. As seen in FIG. 6, the external guide 40-5 can be inserted into the compartment guide 17.

The storage body 40-4 can include one or more internal guides 40-6, each of which can be formed on an inner wall of the storage body 40-4. The storage body 40-4 can include an equal number of guides 40-6 on each of a pair of opposing inner walls. Each pair of guides 40-6 located on opposing inner walls can be aligned so as to receive, slidably guide and hold a divider 46 (for example, shown in FIG. 9B or 9C) between the opposing walls inner walls. Each internal guide 40-6 can be located on the inner wall opposite to a corresponding external guide 40-6 located on the external wall of the storage body 40-4. The divider 46 can be arranged to separate the storage space in the storage body 40-4 into two or more subcompartments.

Figure 9B:
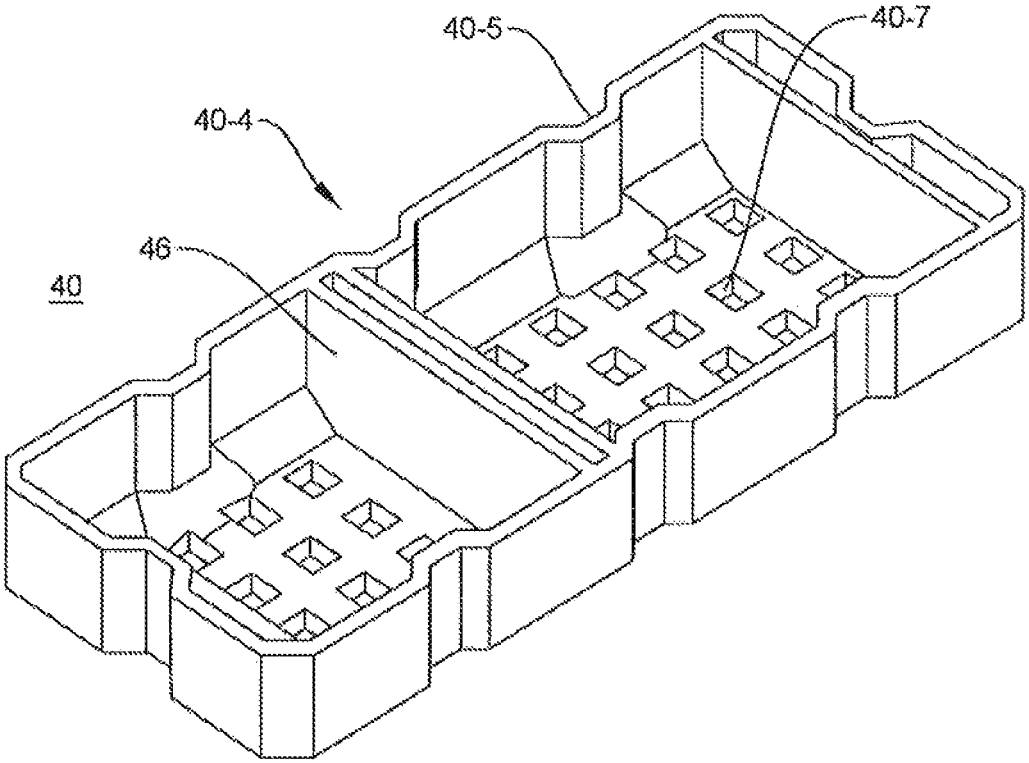

FIG. 9B shows an embodiment of the storage unit 40 having a plurality of drainage holes 40-7 formed in the floor of the storage body 40-4. The storage body 40-4 can include one or more dividers 46, which can be integrally formed with the storage body 40-4 in one piece. The storage unit 40 embodiment shown in FIG. 9B can be used with the storage unit 40 embodiment shown in FIG. 9A, for example, by stacking the former atop of the latter, thereby providing a storage solution for articles, such as tackle, where it is desirable to dry the articles after use in the storage unit 40 having the drainage holes 40-7 (shown in FIG. 9B), and catch the water in the storage unit 40 having a closed bottom (shown in FIG. 9A), thereby preventing the water from leaking into the bottom portion 14 of the utility box 10 (shown in FIG. 6).

Figure 9C:
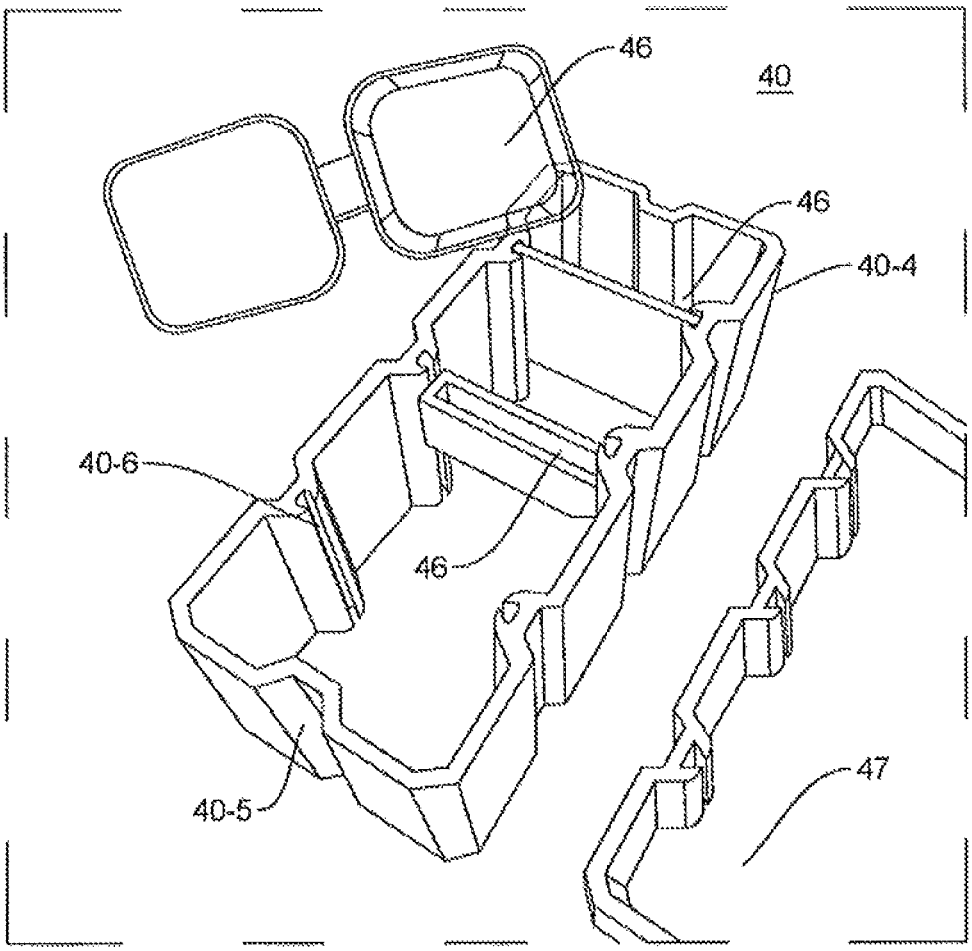

FIG. 9C shows the storage unit 40 with two different non-limiting examples of dividers 46 installed in the storage body 40-4, between oppositely located internal guides 40-6. As seen in FIG. 9C, the storage unit 40 can include a top 47, which can be arranged to fit snuggly atop the storage body 40-4 to form a sealed storage space in the storage body 40-4.

Figure 9D:
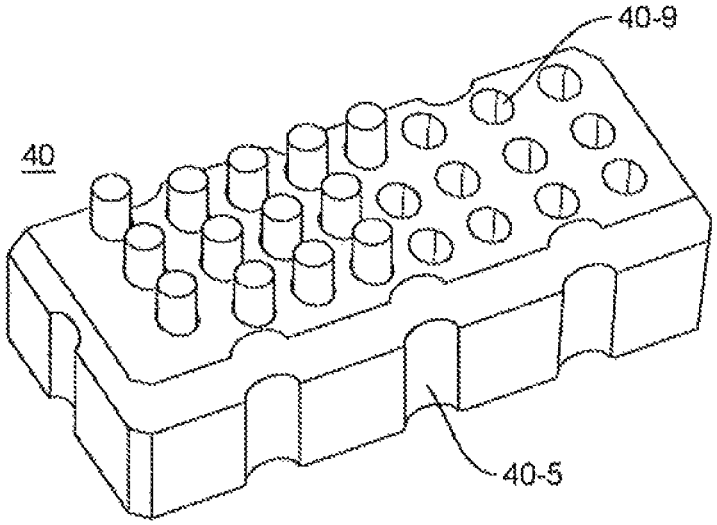

FIG. 9D shows the storage unit 40 having a top surface formed with a plurality of openings 40-9, each of which is constructed to hold an article such as, for example, an ammunition cartridge.

Figure 9E:
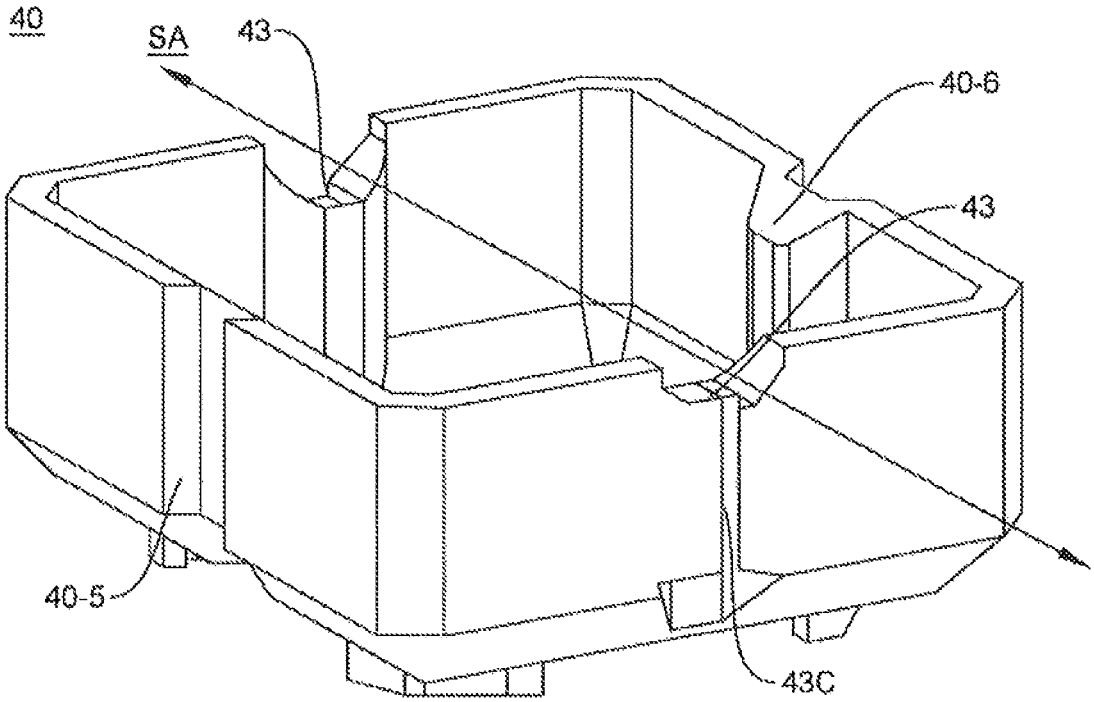

FIG. 9E shows a non-limiting embodiment of the storage unit 40 having one or more fulcrum receptacles 43. The storage unit 40 can include a respective guide channel 43C for each fulcrum receptacle 43. The fulcrum receptacle 43 can be arranged to receive a fulcrum member 50 (shown in FIG. 10). The fulcrum receptacle 43 can be shaped to match the contours of the fulcrum member 50 so that the fulcrum member can be snuggly seated in the fulcrum receptacle.

Figure 10:
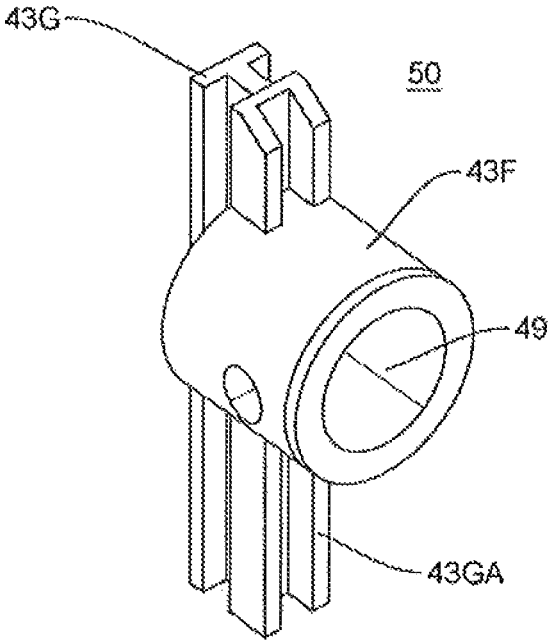
FIG. 10 shows an embodiment of a fulcrum member.

FIG. 10 shows a non-limiting embodiment of the fulcrum member 50. The fulcrum member 50 can include a fulcrum 43F and a guide 43G. The fulcrum 43F can include an opening 49, which can be arranged to receive an end of a rod (not shown). The fulcrum member 50 can include an alternative or additional guide 43GA. The fulcrum member 50 can be used with the storage unit 40 shown in FIG. 9E in at least two different ways.

For instance, the fulcrum member 50 can be attached to the storage unit 40 by inserting the alternative or additional guide 43GA inside the guide channel 43 and sliding the guide 43G in the channel until the fulcrum 43F is seated in the fulcrum receptacle 43. The process can be repeated on the opposing wall of the storage unit 40 with another fulcrum member 50. A rod (not shown) or bar (not shown) can be inserted along an axis SA in each of the openings 49 in the pair of fulcrum members 50. The rod or bar can be arranged to attach to or provide a pivot support for at least one storage cap (not shown). The storage cap (not shown) can be constructed to attach to the rod or bar at one end and, for example, to cover half of the top portion of the storage unit 40A to provide a partial cover.

Alternatively, the guide 43G can be inserted into the guide channel 43 and slidably moved until the fulcrum 43F is seated in, or proximate to, the fulcrum receptacle 43. The process can be repeated with another fulcrum member 50 on the opposing wall of the storage unit 40. In this example, the resultant storage unit 40 could have a pair of fulcrums 43F protruding from the outer body walls of the storage unit 40.

Alternatively, a pair of fulcrum members 50 can be implanted directly into the compartment 19 (shown in FIG. 6) by inserting the guides 43GA into each of a pair of oppositely located guides 17. The rod (not shown) or bar (not shown) can be installed into each of the openings 49 and held by the fulcrums 43F across the width between the fulcrum members 50. A cover (not shown) can be attached to the rod or bar and arranged to cover a portion of the compartment 19 (shown in FIG. 6), which can include enclosing a space in the compartment 19 that is formed between, for example, a pair of adjacent storage units 40, such as, for example, the space in the middle compartment 19 shown in FIG. 6, between the single storage unit 40 at one end and three storage units 40 at the other end of the compartment 19.

Alternatively, two or more storage units 40 (shown in FIG. 9E), each having a pair of fulcrum members 50 attached as described above, can be implanted into the compartment 19. In this regard, the with the external guides 40-5 (shown in in FIG. 9E) on the storage bodies of each of the storage units 40 can be aligned with and slid along respective guides 17 in the compartment 19. A rod (not shown) or bar (not shown) can be inserted through all four openings 49 in the respective fulcrums 43F.

Figure 11:
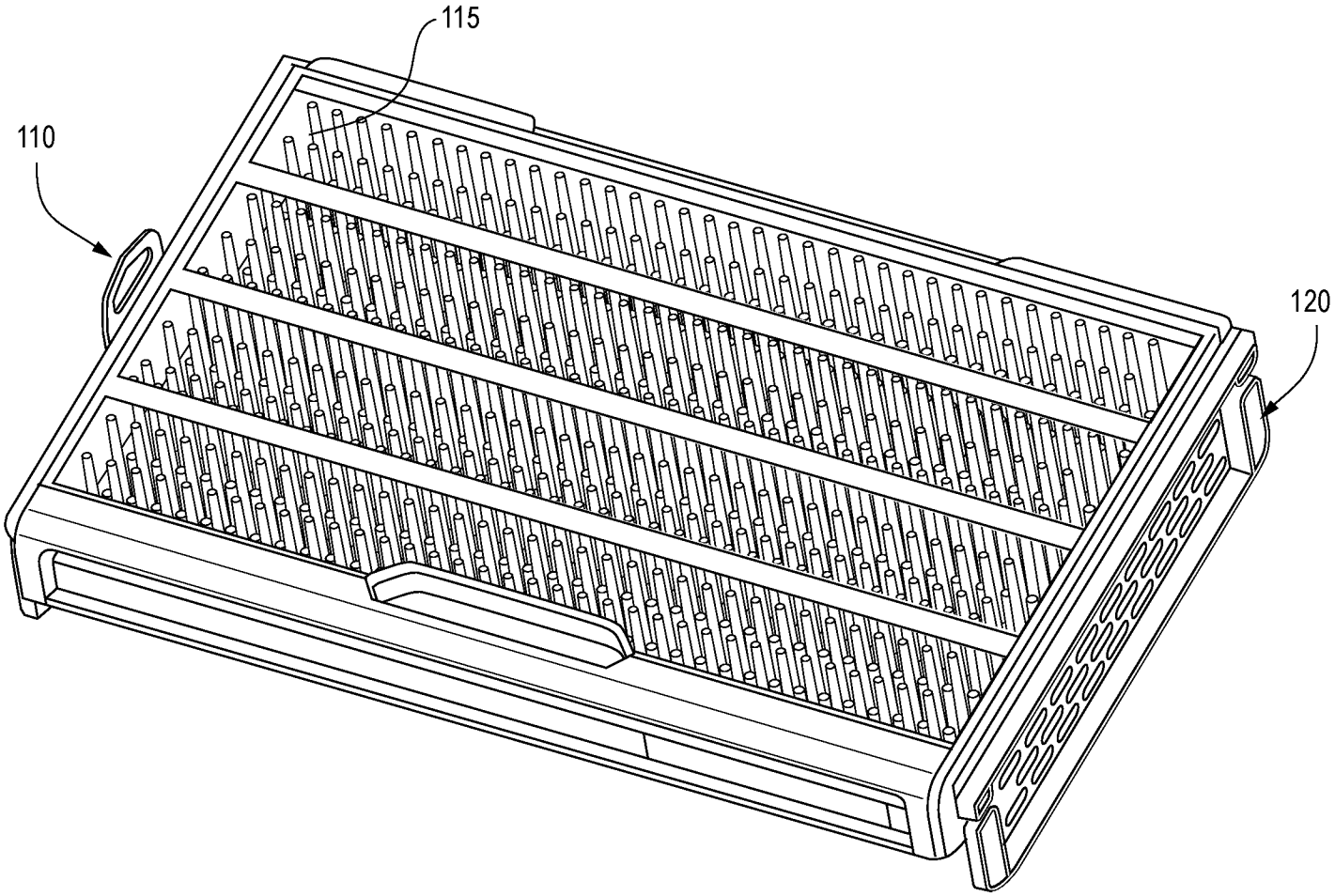
FIG. 11 is a perspective view of a utility box with an alternative embodiment of a storage system.

As set forth above, alternatives to the utility box 10 are foreseeable. FIG. 11 illustrates one such alternative utility box 110. The utility box 110 may include a lid 115 and a container 120 to which the lid 115 is hingedly or otherwise attached. In some embodiments, the lid 115 may be transparent so that a user can see what articles, such as the article 18 (e.g., bait, tackle), are contained within the utility box 110.

Figure 12:
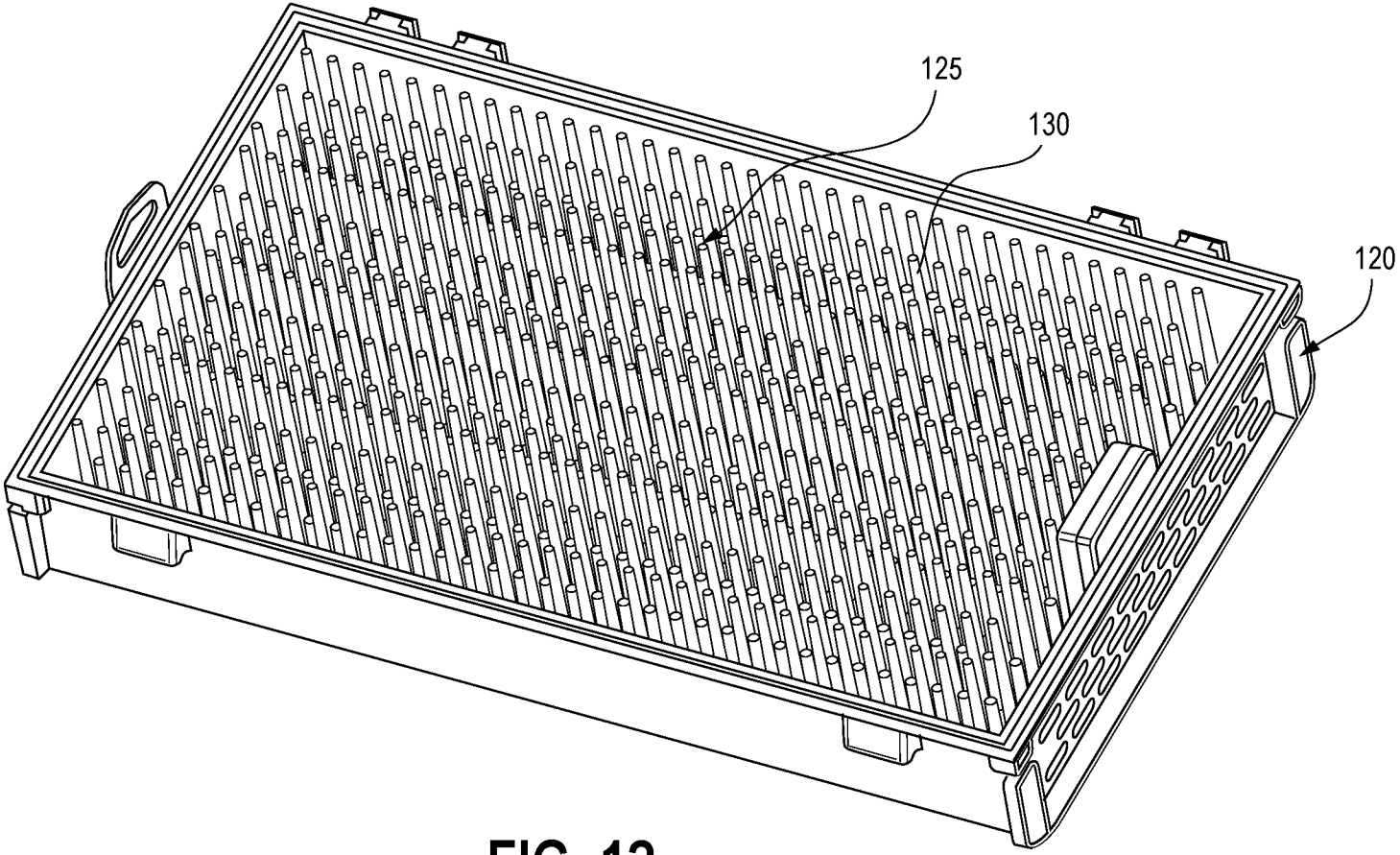
FIG. 12 is a perspective view of a base and holder assembly of the utility box of FIG. 11.

In FIG. 12, the container 120 is illustrated with the lid 115 removed. With the lid 115 removed, an alternatively constructed storage device 125 is more clearly illustrated. The storage device 125, like the storage device 20, includes a plurality of fingers 130 associated therewith that are described in detail below.

Figure 13:
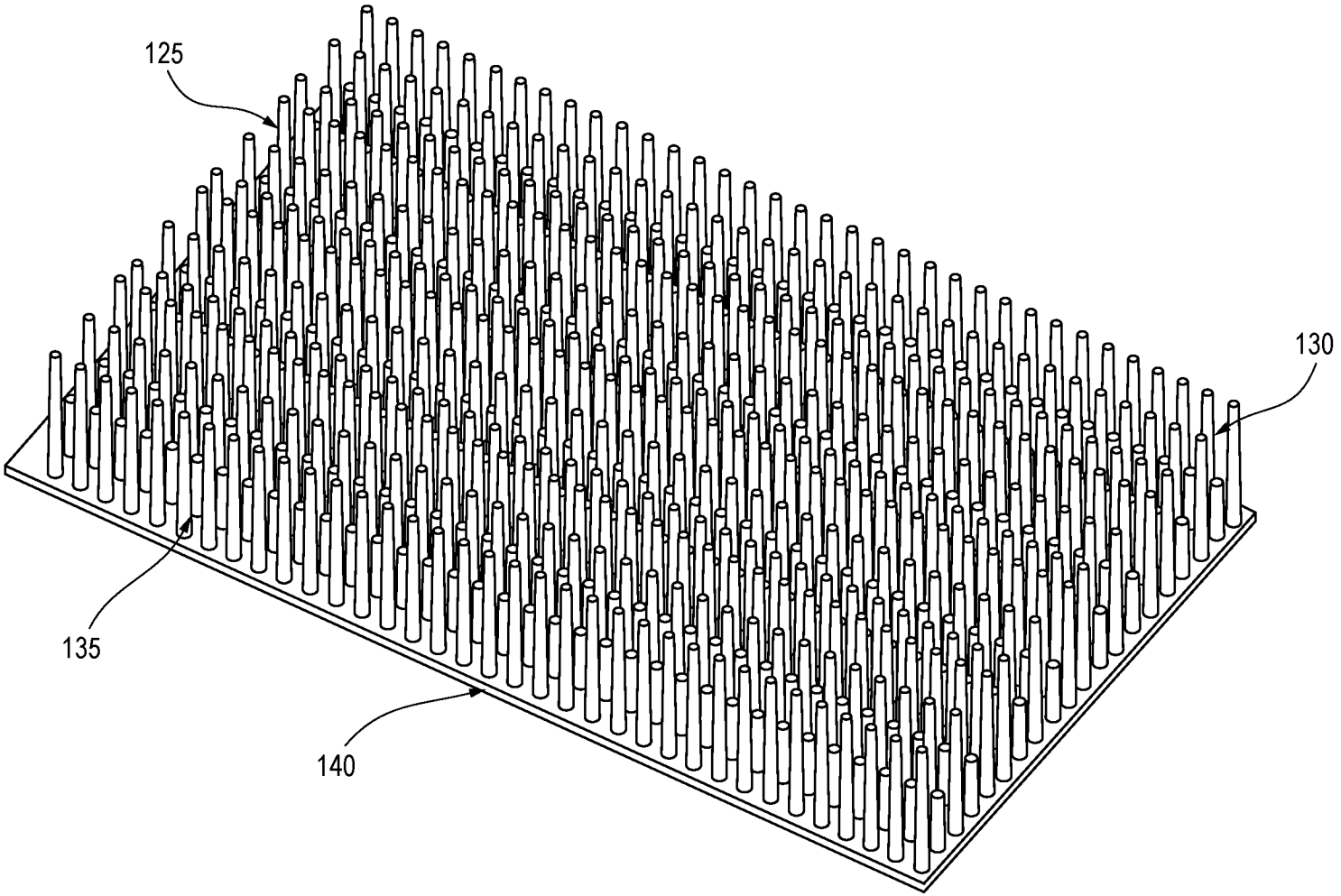
FIG. 13 is a perspective view of the holder assembly of the utility box of FIG. 11.

FIG. 13 illustrates the storage device 125 when it is removed from the container 120. The storage device 125 may include a plurality of insert members 135, each having fingers 130. There are several insert members 135 adjacent to one another in FIG. 13, and as a result, it appears as though the storage device 125 includes one continuous integrally formed insert member 135 that substantially covers the surface area of a base 140 with which the inserts 135 engage. While that configuration is foreseeable, in the embodiment described herein, there are a plurality of inserts 135 adjacent to one another. The manner in which the inserts 135 are engageable with the base 140 such that the fingers 130 project upwardly from the base 140 is set out below.

Figure 14:
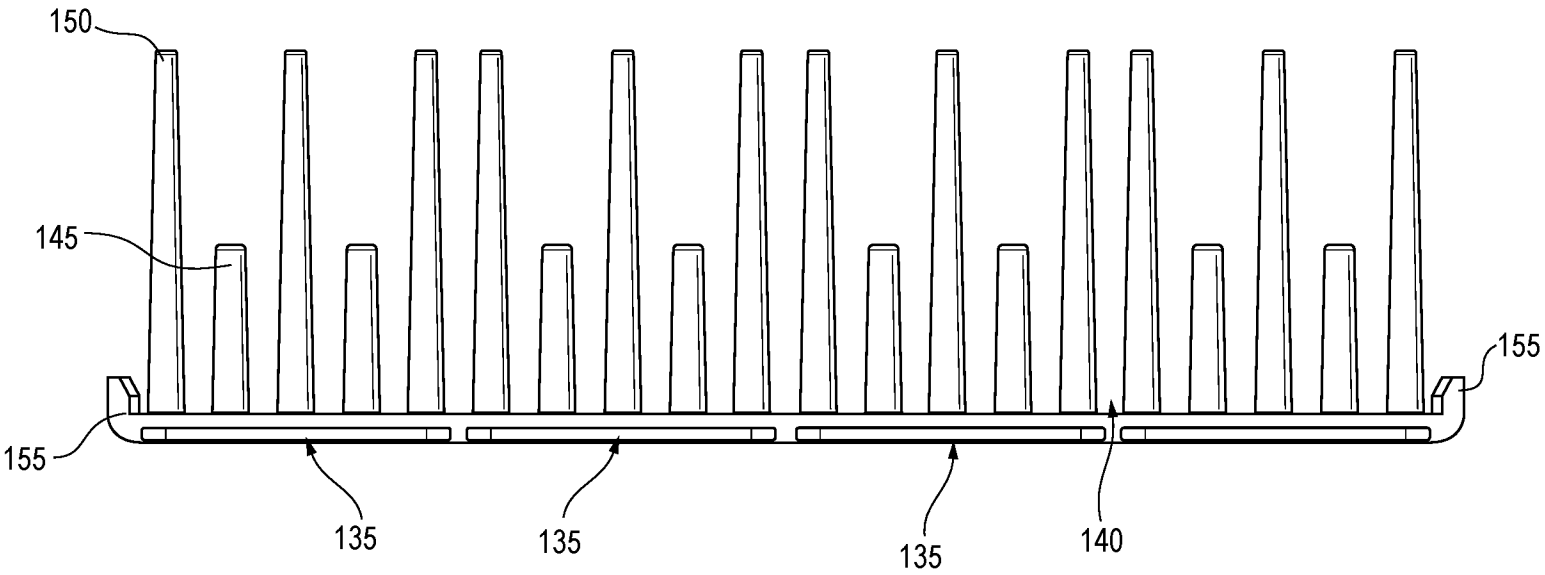
FIG. 14 is a front elevation view of the holder assembly of FIG. 13.

FIG. 14 illustrates that there are several inserts 135 visibly engaged within the base 140 rather than one continuous insert 135.

In FIG. 14, the fingers 130 are illustrated from a front view. As set forth above when describing the fingers 22, the fingers 130 have dimensions selected based on the application for the storage device 125. In the illustrated embodiment of FIG. 14, there are short fingers 145 and long fingers 150 that make up the inserts 135. This combination allows, for example, an angler may securely store both thin and wide baits.

Figure 15:
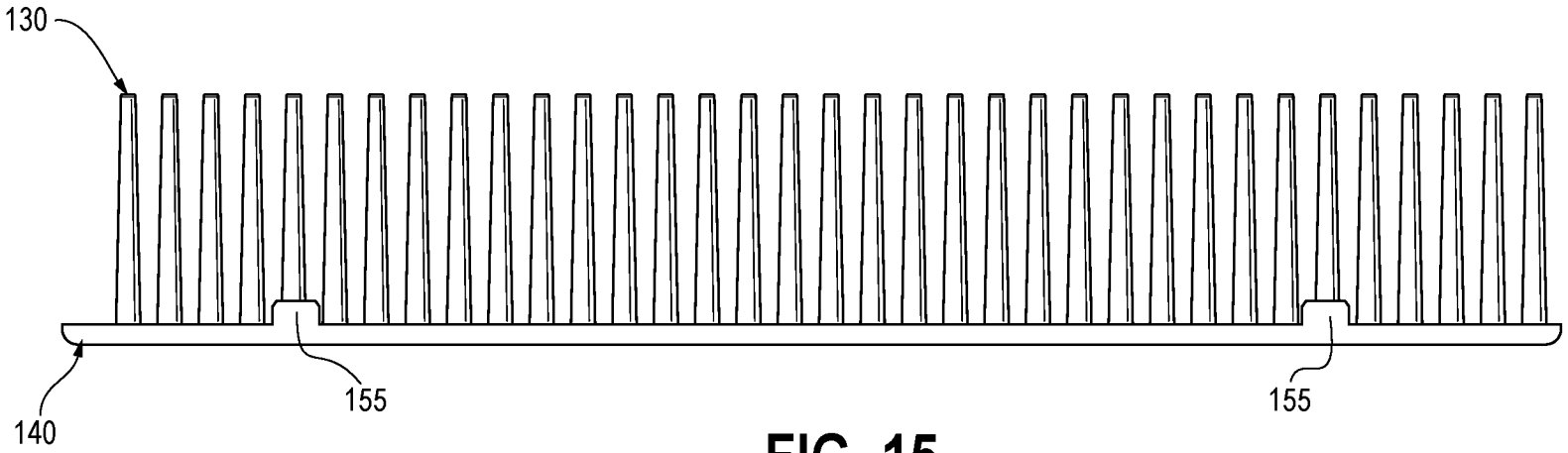
FIG. 15 is a side elevation view of the holder assembly of FIGS. 13 and 14.
Figure 16:
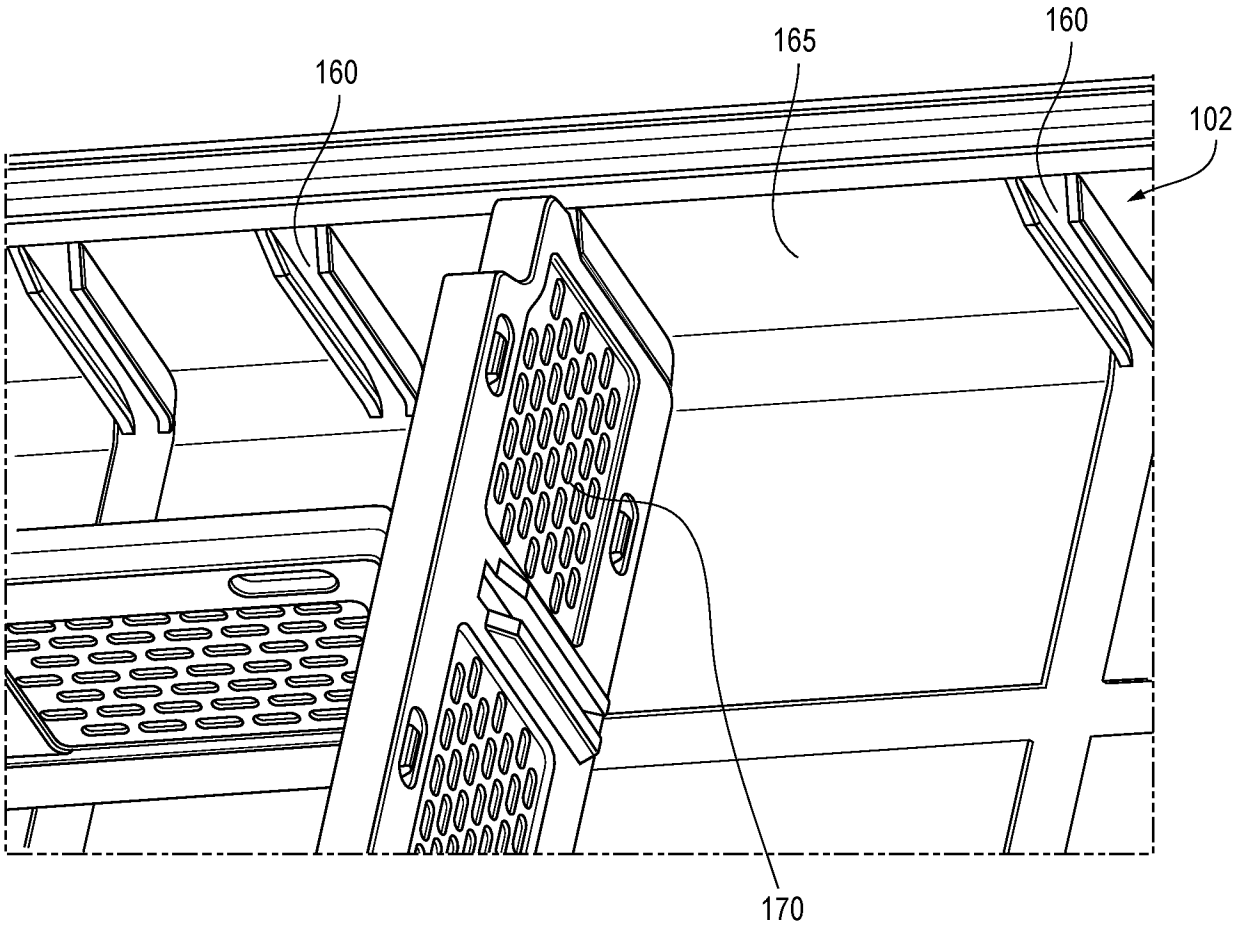
FIG. 16 is an enlarged perspective view of a portion of the base of FIGS. 11 and 12.
Figure 17:
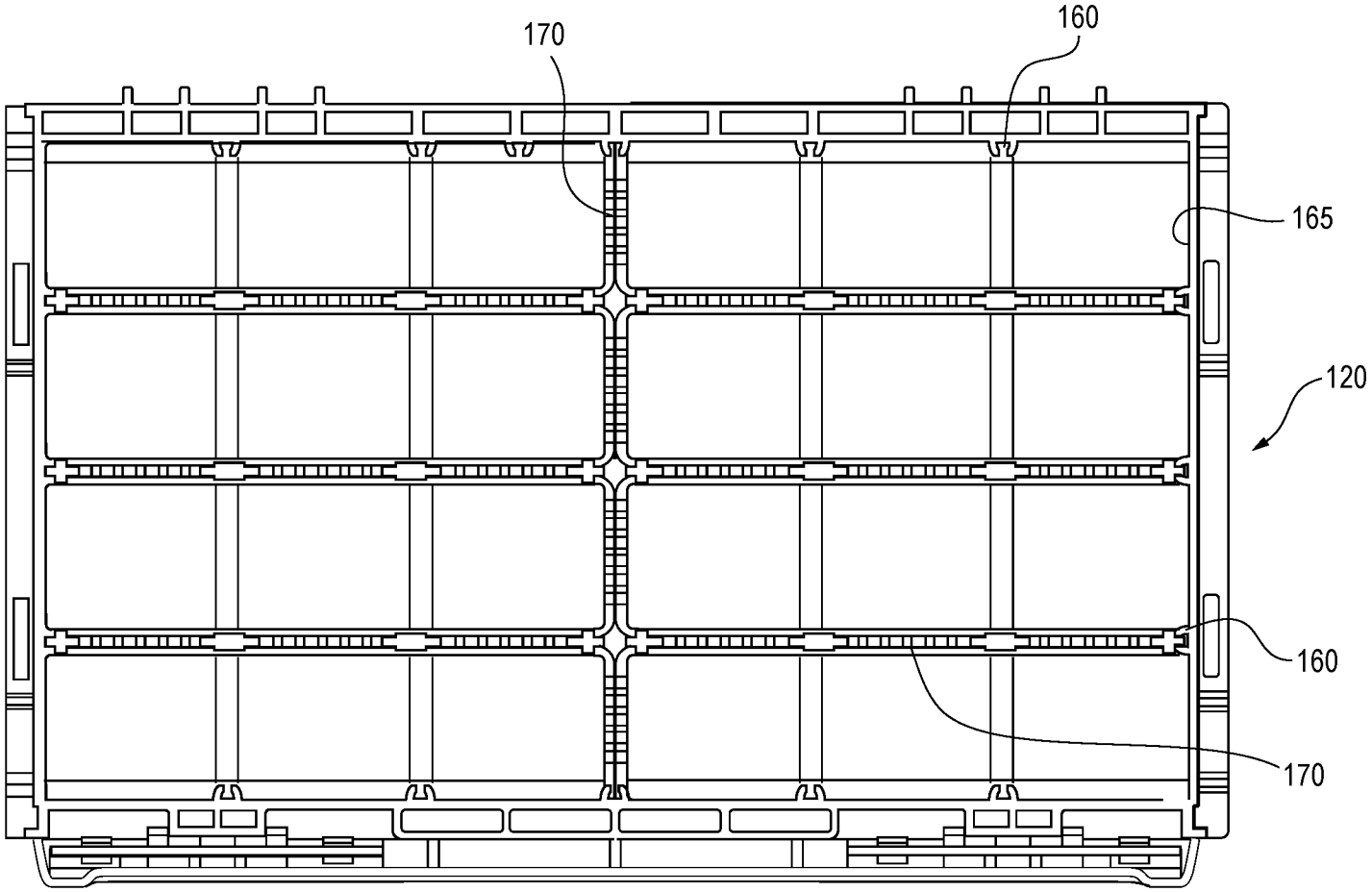
FIG. 17 is a plan view of the base of FIGS. 11, 12, and 16.

The base 140 preferably includes a plurality of dovetail members 155 around its perimeter, which are illustrated in FIGS. 14 and 15. The dovetail members 155 are sized and shaped to be receivable within channel members 160 found within an inner perimeter 165 of the container 120. In FIGS. 16 and 17, the channel members 160 are clearly illustrated, and they are also visible in earlier described FIG. 1. In FIGS. 16 and 17, divider members 170 are illustrated as engaged with the channel members 160. However, when the base 140 is engaged with the container 120, the dovetail members 155 may be received and engaged within the channel members 160 in a manner substantially similar to the manner in which the divider members 170 are engaged with the channel members 160. More particularly, the dovetail members 155 may be slidingly engaged via a friction fit within the channel members 160.

While FIGS. 16 and 17 illustrate the container 120 including divider members 170, as set forth above, the base 140 may similarly be engaged within the container 120. In some embodiments, a smaller base substantially similar to the base 140 may be engageable with the container 120. Then, divider members 170 may also be engageable in the same container 120 to give the user a desired combination of divider members 170 and bases 140 that subsequently retain inserts 135 having fingers 130. That way, a user may configure the container 120 however he or she desires to store articles, such as but not limited to the articles 18.

Figure 18:
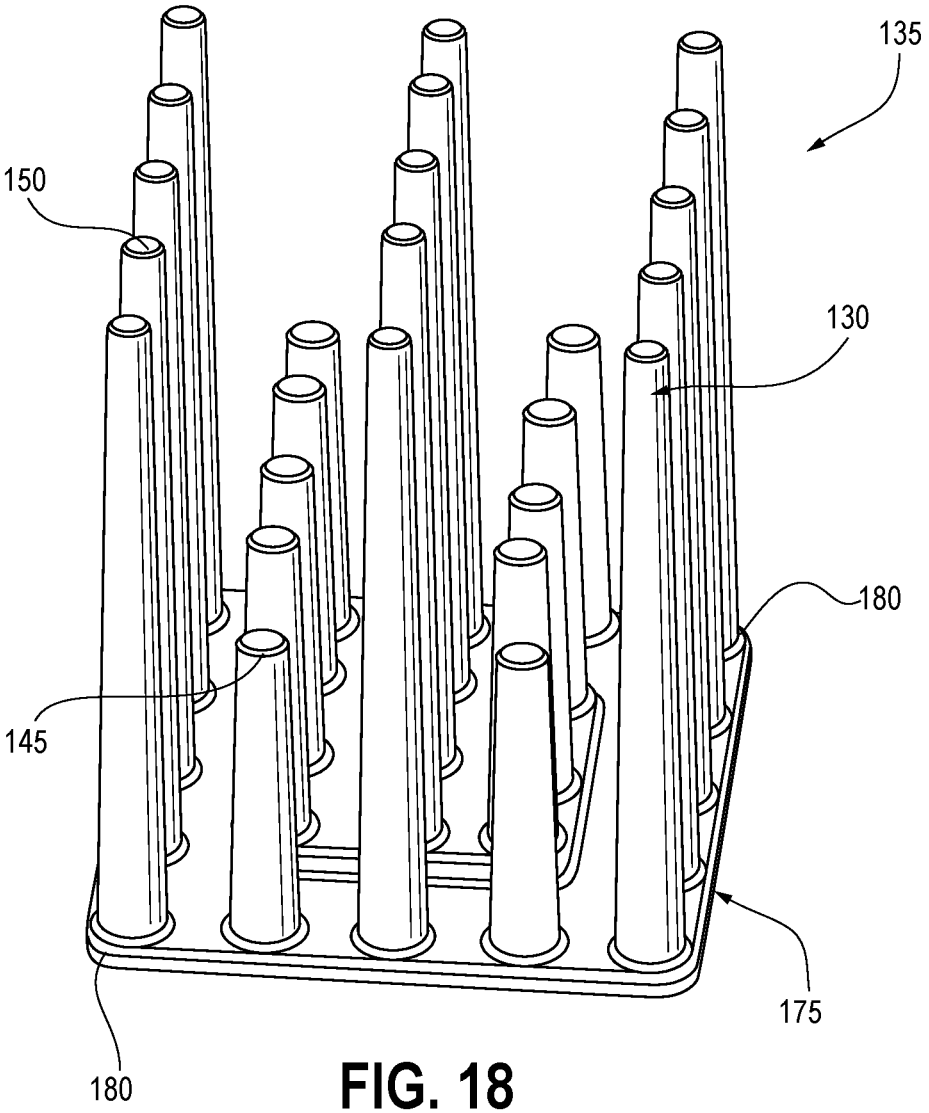
FIG. 18 is a perspective view of an insert that may be engaged within the utility box of FIG. 11.
Figure 19:
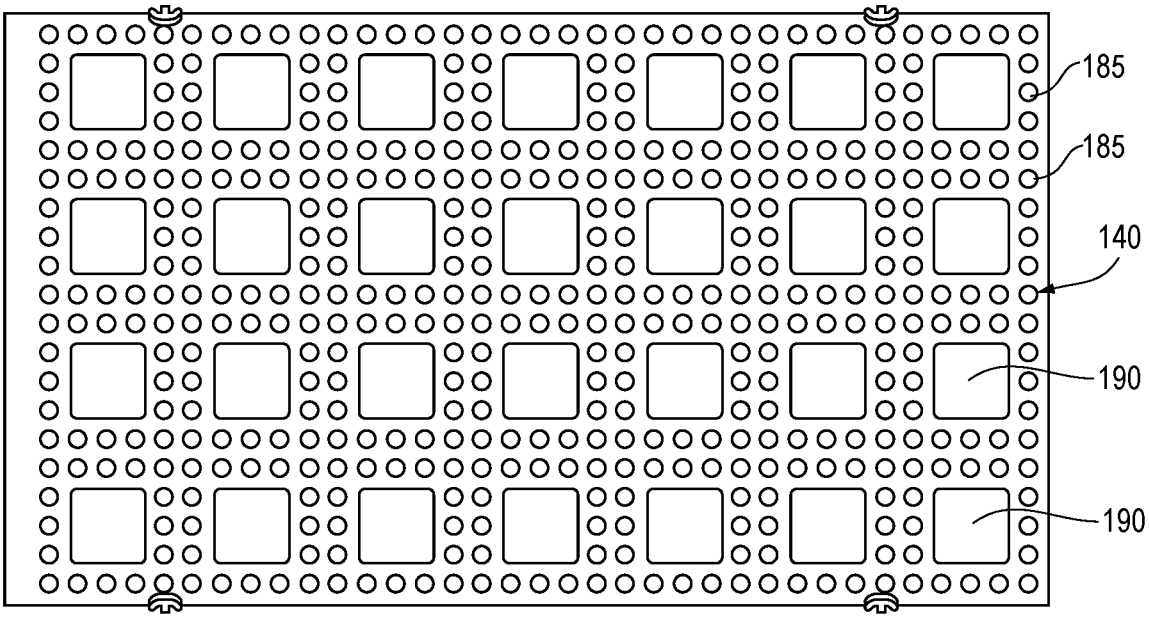
FIG. 19 is a perspective view of an insert plate that is selectively engageable with the insert of FIG. 18.

FIG. 18 illustrates a single insert 135 having fingers 130, including short fingers 145 and long fingers 150. The insert 135 preferably includes a square-shaped platform 175 having rounded corners 180 from which the fingers 130 extend upwardly. The insert 135 as illustrated includes twenty-five fingers 130 arranged in a five by five square pattern. The fingers 130 around the perimeter of the insert 135, of which there are sixteen in the illustrated embodiment, are engageable with the base 140, which is illustrated in FIG. 19. In other embodiments, any number or arrangement of fingers 130 as appropriate of the size and shape of the insert 135 can be used.

The base 140 preferably includes a plurality of apertures 185 that are sized and positioned to receive the fingers 130 placed around the perimeter of any given insert 135. The remaining fingers 130 that are found on the interior of the insert 135 (the "non-perimeter" fingers 130), of which there are nine in the embodiment of FIG. 18, are received within a hole 190 surrounded by the apertures 185. When an individual insert 135 is received in the base 140, its fingers 130 are received within the apertures 185 and a hole 190. Preferably, the apertures 185 are sized to receive and retain the "perimeter" fingers snugly therein.

Figure 20:
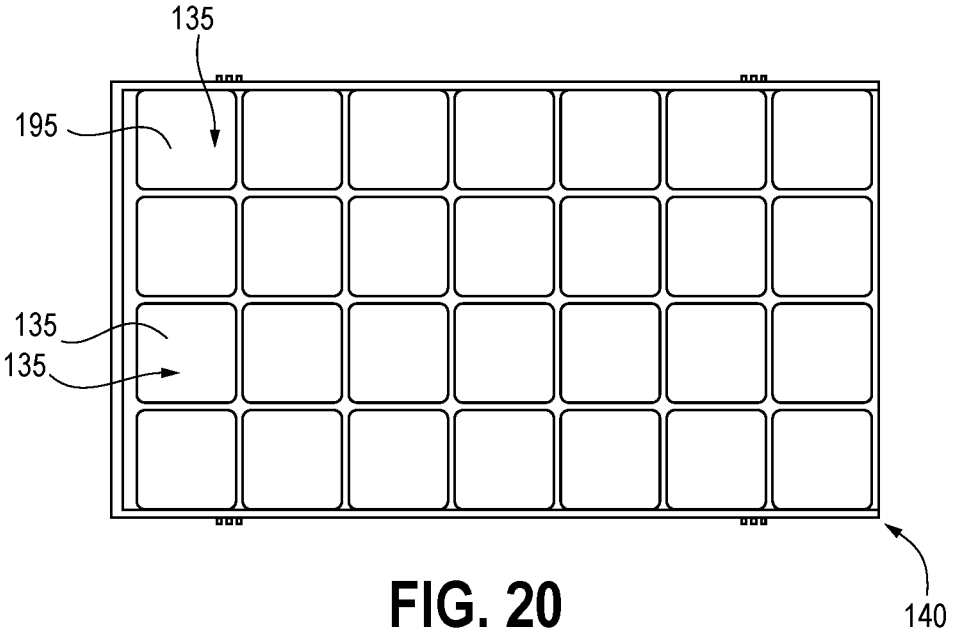
FIG. 20 is a bottom plan view of the insert of FIG. 18 engaged with the insert plate of FIG. 19.

FIG. 20 illustrates a plurality of bottom sides 195 of a plurality of inserts 135 received within holes 190 and apertures 185 (not illustrated) in the base 140. In the embodiment illustrated in FIG. 20, there are twenty-eight inserts 135 received within the base 140, but in alternative constructions where dimensions in the inserts 135 and/or base 140 varies, more or fewer inserts 135 may be provided.

Figure 21:
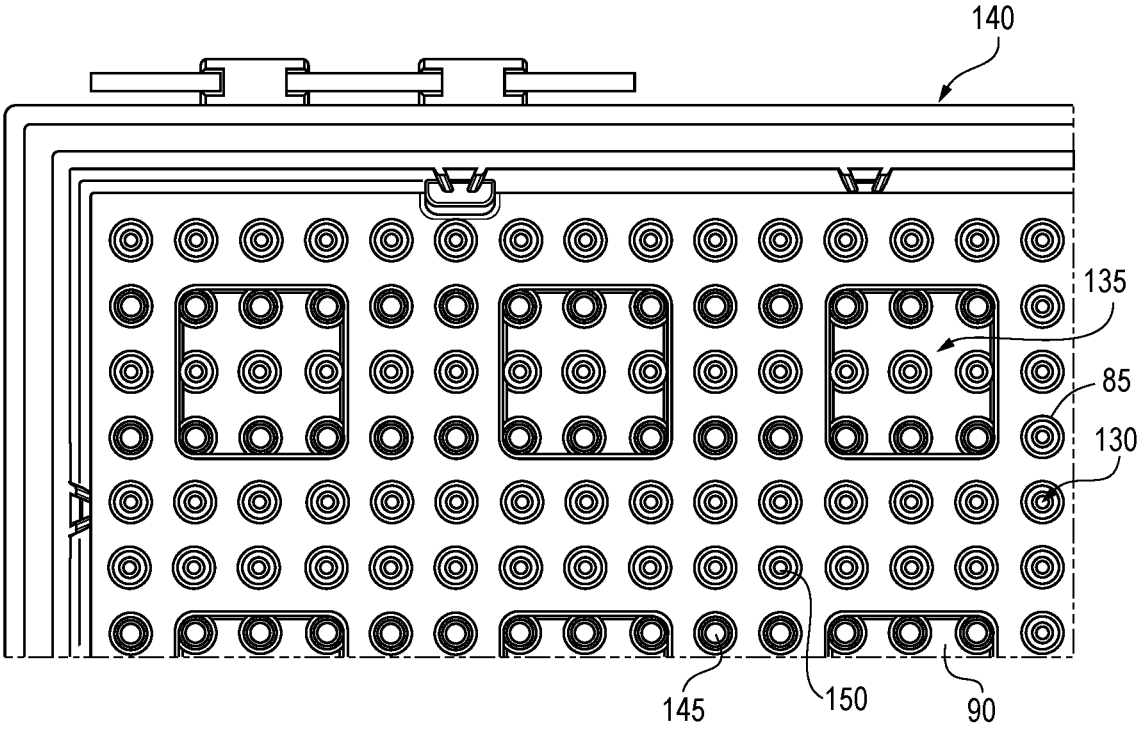
FIG. 21 is a top plan view of the insert of FIG. 18 engaged with the insert plate of FIG. 19.
Figure 22:
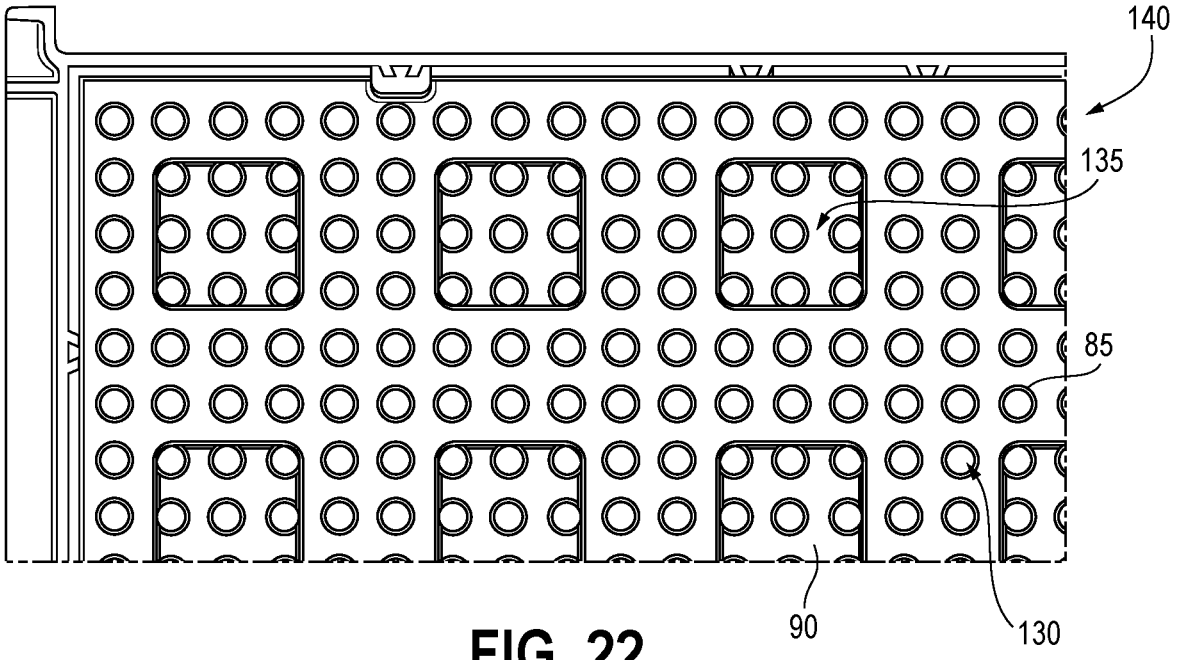
FIG. 22 is second top plan view of an alternative insert engaged with the insert plate of FIG. 19.

FIGS. 21 and 22 illustrate inserts 135 received within the base 140 from a top view, where the apertures 185 and the holes 190 are visible. In FIGS. 20 and 21, fingers 130 are illustrated as projecting upwardly from within the apertures 185 or from within the hole 190. In FIG. 21, the fingers 130 are of varying lengths and thus include both the short fingers 145 and the long fingers 150. In FIG. 22, the fingers 130 are of uniform size and shape, like the fingers 22.

Figure 23:
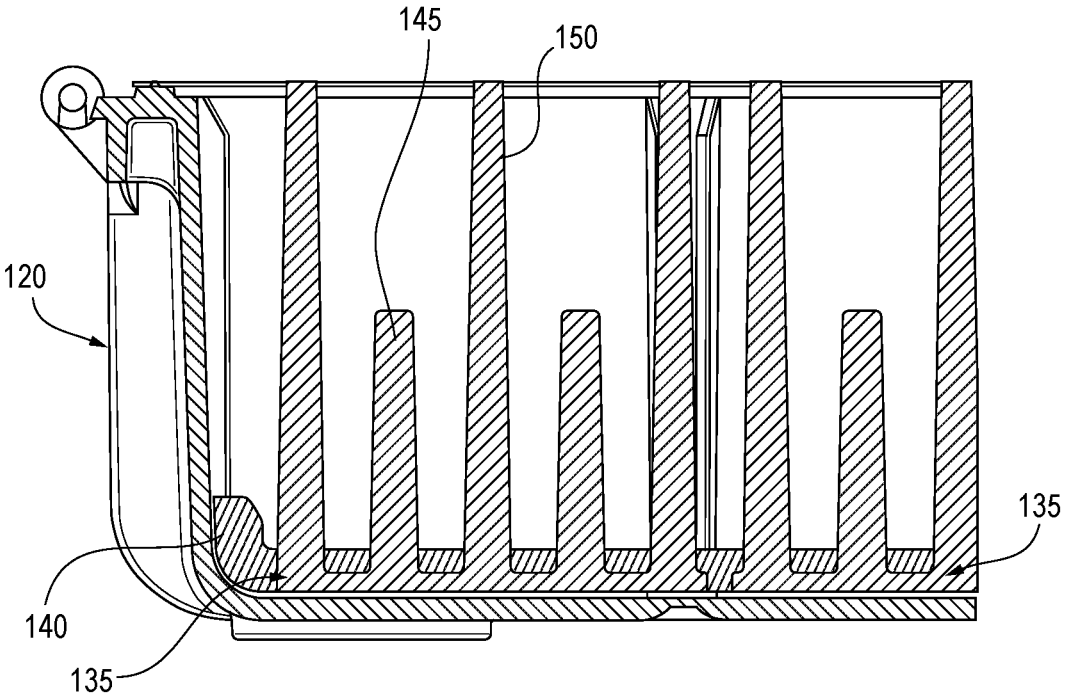
FIG. 23 is a cross-section elevation view of the insert of FIG. 18 engaged with the insert plate of FIG. 19.

FIG. 23 illustrates a side view of two inserts 135 engaged within the base 140, which is further retained in a container 120. The fingers 130 of the inserts 135 in FIG. 23 include each of the short fingers 145 and the long fingers 150.

The terms "a," "an," and "the," as used in this disclosure, means "one or more," unless expressly specified otherwise.

The terms "including," "comprising," and variations thereof, as used in this disclosure, mean "including, but not limited to," unless expressly specified otherwise.

Although process steps, method steps, or the like, may be described in a sequential order, such processes and methods can be configured to work in alternate orders. In other words, any sequence or order of steps that may be described does not necessarily indicate a requirement that the steps be performed in that order. The steps of the processes or methods described herein can be performed in any order practical. Further, some steps can be performed simultaneously.

When a single structure or article is described herein, it will be readily apparent that more than one device or article may be used in place of a single device or article. Similarly, where more than one device or article is described herein, it will be readily apparent that a single structure or article may be used in place of the more than one structure or article. The functionality or the features of a structure or article may be alternatively embodied by one or more other structures or articles that are not explicitly described as having such functionality or feature.

While the disclosure has been described in terms of exemplary embodiments, those skilled in the art will recognize that the disclosure can be practiced with modifications in the spirit and scope of the instant disclosure. These examples given above are merely illustrative and are not meant to be an exhaustive list of all possible designs, embodiments, applications or modifications of the disclosure.

What is claimed is:

1. A utility box having a storage system with reconfigurable compartments, the utility box comprising:

a container for receiving articles therein;

a base selectively engageable with the container; and an insert selectively engageable with the base, the insert including a plurality of fingers projecting upwardly from a platform of the insert, wherein the plurality of fingers comprises a first set of fingers and a second set of fingers, wherein the first set of fingers have a length greater than a length of the second set of fingers.

2. The utility box of claim 1, further comprising a lid hingedly coupled to the container.

3. The utility box of claim 1, wherein the container defines at least one channel on a perimeter wall.

4. The utility box of claim 3, wherein the base comprises at least one dovetail component that is selectively and slidably engageable with the at least one channel.

5. The utility box of claim 1, further comprising at least one divider.

6. The utility box of claim 5, wherein the at least one divider is selectively engageable with the container.

7. The utility box of claim 6, wherein the at least one divider is selectively and slidably engageable with at least one channel defined by a perimeter wall of the container.

8. The utility box of claim 6, wherein the at least one divider is selectively engageable with the container and is positioned over the base to divide the insert into different sections.

9. The utility box of claim 6, wherein the at least one divider is selectively engageable with the container and is positioned adjacent to the insert to divide the container into an insert section and a non-insert section.

10. The utility box of claim 1, wherein the plurality of fingers is made from a rubber material, a plastic material, polyvinyl chloride, low-density polyethylene, polystyrene, or a combination thereof.

* * * * *